United States Patent [19]

Ressler et al.

[11] Patent Number: 4,823,972

[45] Date of Patent: Apr. 25, 1989

[54] COLLAPSIBLE CHILD'S TOY CONTAINER

[76] Inventors: Gerald S. Ressler; Gail E. Ressler, both of 11100 Lighthouse Dr., Apt. 126, Belleville, Mich. 48111

[21] Appl. No.: 140,615

[22] Filed: Jan. 4, 1988

[51] Int. Cl.[4] ..... B65D 7/00

[52] U.S. Cl. ..... 220/4 F; 220/84

[58] Field of Search ..... 220/4 F, 84; 383/33, 383/104

[56] References Cited

U.S. PATENT DOCUMENTS

| | | | |
|---|---|---|---|
| 1,277,094 | 8/1918 | McClay et al. | 220/84 |
| 2,818,192 | 12/1957 | Weiner | 220/4 F |
| 3,105,617 | 10/1963 | Felldin | 220/84 X |
| 3,265,240 | 8/1966 | Cloyd | 220/84 |
| 3,382,625 | 5/1968 | Kuss | 220/84 X |
| 3,955,702 | 5/1976 | Lundy | 220/4 F |
| 4,212,406 | 7/1980 | Mittelmann | 220/84 X |

*Primary Examiner*—Steven M. Pollard

*Attorney, Agent, or Firm*—Charles W. Chandler

[57] ABSTRACT

A collapsible child's toy container formed of a plurality of plastic tubular members, and a fabric covering for the frame formed by the tubular members. The cover is arranged such that the end rails of the frame are exposed to form handles for carrying the container.

10 Claims, 2 Drawing Sheets

COLLAPSIBLE CHILD'S TOY CONTAINER

BACKGROUND OF THE INVENTION

This invention is related to a child's collapsible toy container and storage unit, and more particularly to a collapsible toy container formed of lightweight flexible tubular frame members assembled so there are no sharp corners, and including a fabric cover forming the walls and top of the container.

Children's toys are commonly stored in some form of box-like container. However, for very young children it is necessary that the container have no sharp corners, be lightweight, and not have any structure that will pinch the child.

SUMMARY OF THE INVENTION

The broad purpose of the present invention is to provide a lightweight, safe container for child's toys that will take abuse, and has neither sharp corners nor pinch points for a child. Further, it can be collapsed, and provided with fabric side walls in a variety of colors.

The preferred embodiment of the invention has a collapsible frame formed of sections of plastic tubing which when assembled permits the child to safely bounce off the sides of the frame. The frame includes a pair of rails that extend beyond the fabric cover to form handles useful for relocating the container. The preferred embodiment can be used either with or without a rigid bottom panel that is useful for taking abuse from the toys and for preventing the fabric material from being punctured.

Still further objects and advantages of the invention will become readily apparent to those skilled in the art to which the invention pertains upon the reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
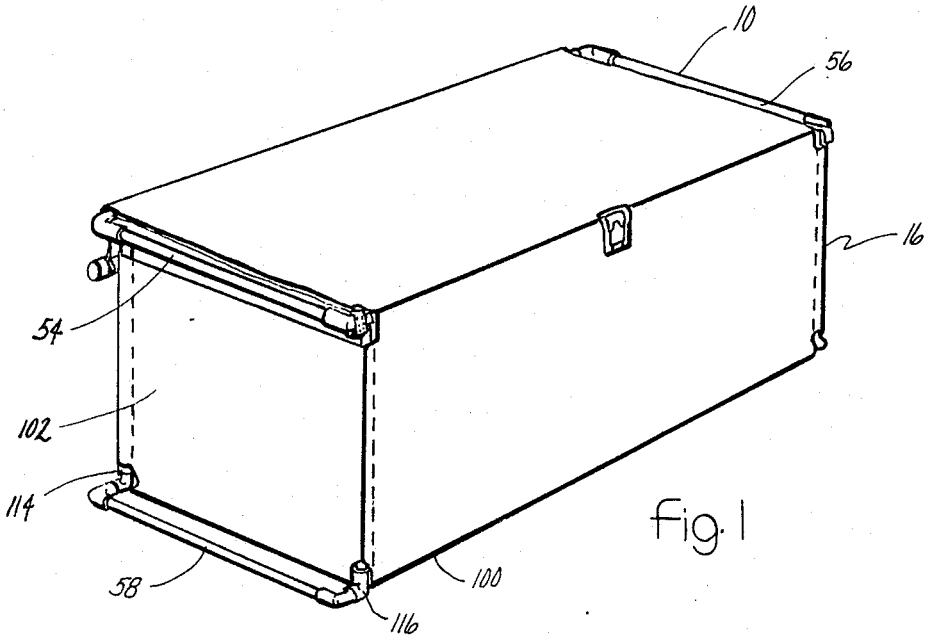
FIG. 1 is illustrates the preferred container with the top flap closed.

Referring to the drawings, a preferred child's toy container 10 is illustrated in FIG. 1 and comprises a tubular frame 12, a floor panel 14 and a fabric cover 16.

Figure 2:
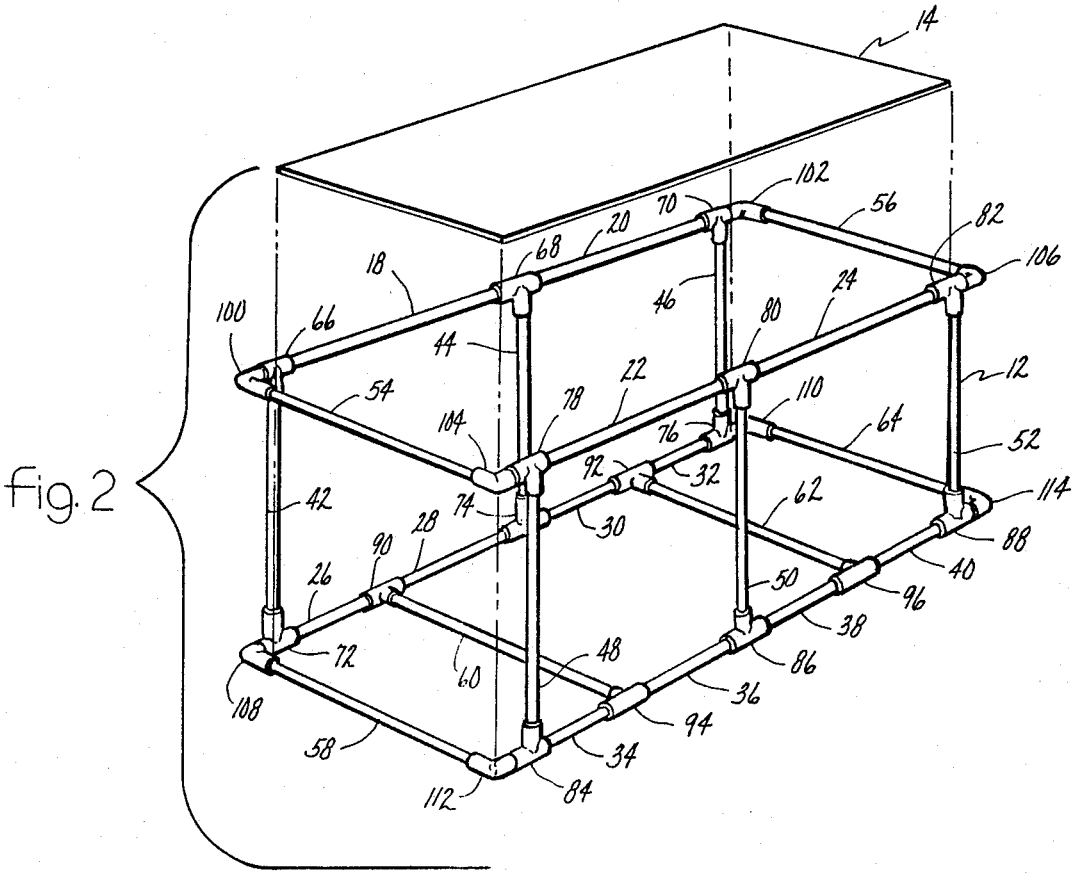
FIG. 2 is a view illustrating the container with the cover removed and the floor panel separated from the bottom of the frame.
Figure 3:
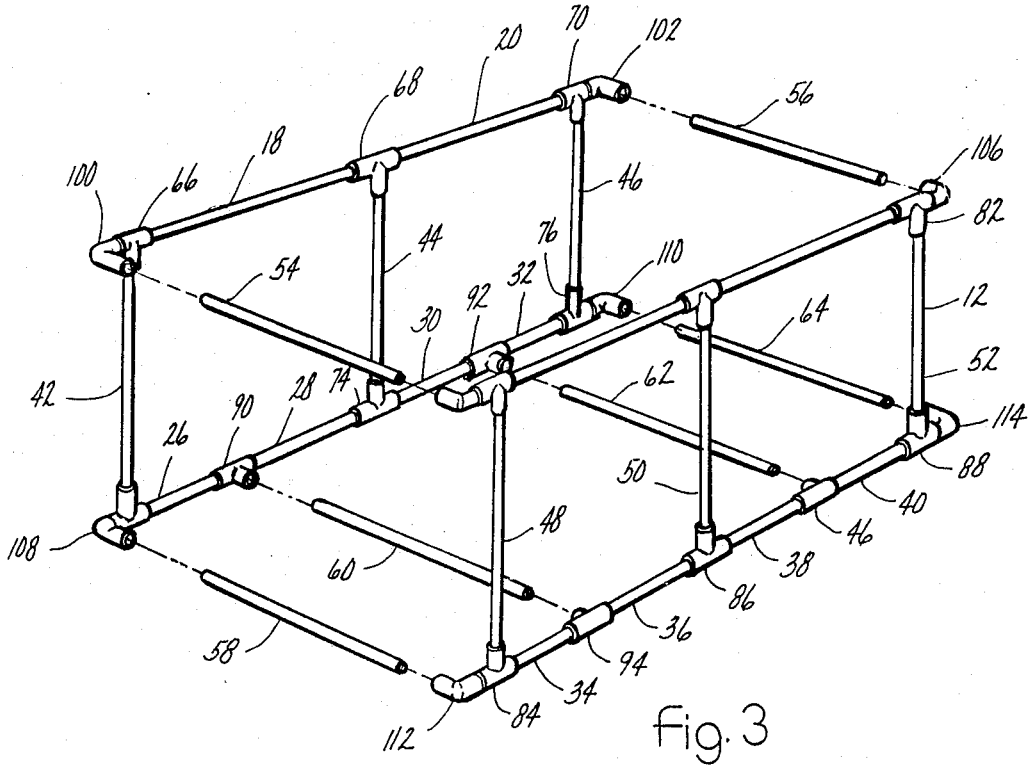
FIG. 3 is a view illustrating various frame components separated, one from the other.
Figure 4:
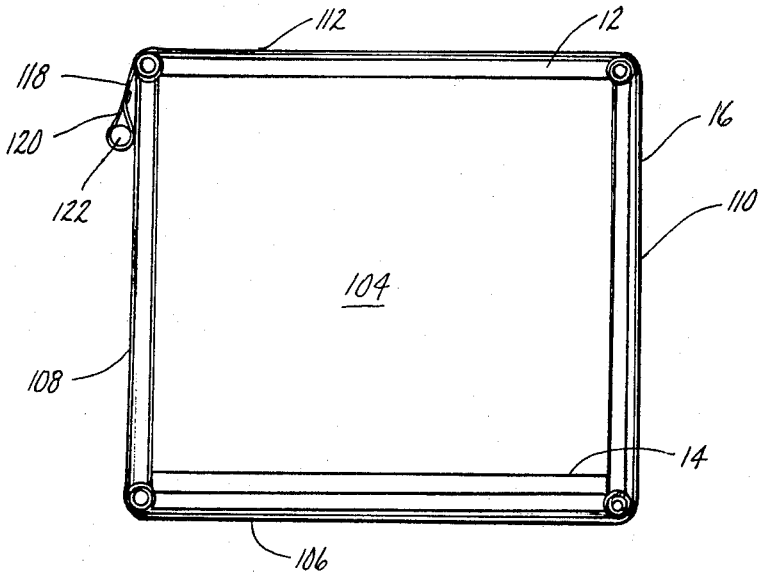
FIG. 4 is an elevational sectional view of the container.

Referring to FIGS. 2 and 3, frame 12 comprises four upper tubular side rails 18, 20, 22 and 24, having an identical length, and eight bottom tubular side rails 26, 28, 30, 32, 34, 36, 38 and 40. Side rails 26 to 40 have the same length. The frame also includes vertical tubular legs or corner posts 42, 44, 46, 48, 50 and 52. Vertical legs 42-52 are preferably formed of a plastic material and also have the same length. The frame includes six cross-rails 54, 56, 58, 60, 62 and 64. Cross-rails 54-64 are formed of a plastic tubular material and have a common length.

"T" shaped corner connectors 66, 68, 70, 72, 74 and 76 are attached to the upper and lower ends of legs 42, 44 and 46, respectively. Each "T" shaped connector has a vertically extending opening telescopically receiving a leg end. Similarly, "T" shaped connectors 78, 80, 82, 84, 86 and 88 are telescopically received by the upper and lower ends of legs 48, 50 and 52, respectively. All of the "T" shaped connectors are identical to one another, formed of a plastic body and have a pair of end openings facing in opposite directions along a longitudinal axis.

T-shaped connectors 66 and 68 are telescopically attached to the opposite ends of side rail 18. T-shaped connectors 68 and 70 are telescopically attached to the ends of side rail 20.

T-shaped connectors 78 and 80 are telescopically attached to the opposite ends of rail 22, and T-shaped connectors 80 and 82 have their openings telescopically receiving the ends and are attached to the ends of side rail 24. Similarly, T-shaped connectors 90, 92, 94 and 96 are telescopically attached to the ends of bottom side rails 26, 28, 30 and 32 on one side and rails 34, 36, 38 and 40 on the other side to form a pair of bottom side frame sections. T-shaped connectors 90 and 94 also releasably, telescopically receive the ends of cross-rail 60. T-shaped connectors 92 and 96 telescopically, releasably receive the ends of bottom cross-rail 62. Floor panel 14 rests on cross-rails 60 and 62.

Four upper, right-angle, hollow, corner connectors 100, 102, 104 and 106 are attached by suitable adhesive means to the outer ends of T-shaped connectors 66, 70, 78, and 82, respectively, so as to be disposed in the common plane with rails 18, 20, 22 and 24. End rail 54 has its ends telescopically releasably received in similarly shaped corner connectors 100 and 104. Upper corner connectors 102 and 106 telescopically releasably receive the ends of cross-rail 56 so that it is disposed in a common plane with the upper side rails and end rail 54.

Similarly, bottom corner connectors 108, 110, 112 and 114 are attached to the outer ends of T-shaped connectors 72, 76, 84 and 88. The opposed ends of corner connector 108 and 112 telescopically, releasably receive the ends of rail 58. The opposed ends of corner connectors 110 and 114 telescopically, releasably receive the ends of rail 64. The arrangement is such that cross-rails 58, 60, 62 and 64 are releasably received either by corner connectors or T-shaped connectors so that the container can be collapsed into a pair of side frame sections.

It is further to be noted that end rails 54, 56, 58 and 64 are spaced from corner leg members 42, 46, 48 and 52 to form handles for carrying the container. Further, side rails 18, 20, 22, 24 and end rails 54 and 56 define a top opening for the container.

All eight corner connectors are formed of a plastic material and have open ends disposed at right angles, one to the other.

All of the frame components are formed of a plastic material sufficiently strong to provide a resilient frame so that a child can bounce against the frame without injuring himself. Further, the corners do not have any sharp edges for injuring the child.

Bottom floor panel 14 is formed of a suitable pressed wood material, and has a length and width such that it can be received into the frame to rest on cross-members 60 and 62.

A fabric cover 130 encloses the bulk of frame 12. Cover 130 has an end wall 132, an opposite end wall 134, a bottom wall 136, side wall 138, an opposite side wall 140 and a top flap 142. The cover is a unitary hollow bag-like element for enclosing the frame but has a pair of bottom openings 144 and 146 in end wall 152 for end rail 58 to project. Similarly, the top of end wall 140 is short, just below cross-rail 54 which extends with its corner connectors beyond the cover to provide an upper handle for relocating the container.

Similarly, the opposite end wall has appropriate openings so that cross rail 56 and cross rail 54 are exposed to provide handles for the container. Flap 142 is continuous with sidewall 140, and its free edge is stitched at 148 to form a loop 120 for receiving a tubular member 122. Member 122 extends the full length of the flap, and forms a weight tending to hold the flap in position over the articles disposed in the container.

Thus it is to be understood that I have described an improved child's toy container having no sharp edges, and in which the side frame sections are somewhat resilient so that the child can fall against the container without injuring himself. In addition, the container is formed of lightweight plastic components and a fabric cover so that the child or the mother can readily move the container to relocate it.

Having described my invention, we claim:

1. A collapsible toy container comprising: a three dimensional rectangular frame structure that includes two parallel upright side frames;

each side frame comprising an upper tubular side rail, a bottom tubular side rail, and two upright tubular corner posts extending therebetween;

two parallel spaced tubular rails (60, 62) extending between the bottom side rails on the respective side frames; said cross rails being located inwardly from the ends of the respective bottom rails;

a flexible fabric cover having a hollow bag-like configuration; said fabric cover comprising a bottom fabric panel having a rectangular configuration matching the plan dimension of the space circumscribed by the corner posts, two fabric flat side panels extending right angularly from side edges of the bottom panel, and two fabric flat end panels extending right angularly from end edges of the bottom panel; the upstanding side edges of the end panels being joined to the adjacent side edges of the side panels, whereby the panels form a hollow flexible bag structure;

bottom end rails releasably connected to end areas of the bottom end rails;

and upper end rails releasably connected to upper ends of adjacent ones of the corner posts;

said bag structure having internal dimensions mated to the external dimensions of the rectangular frame structure, whereby the frame structure can be positioned on the bottom panel of the bag structure, after which the fabric end panels and side panels can be pulled upwardly to grip outer surface areas of the corner posts.

2. The container of claim 1, and further comprising a rigid floor panel removably disposed on the two parallel cross rails; said floor panel having a rectangular configuration essentially the same as the plan space circumscribed by the corner posts.

3. The container of claim 1 wherein the rails and corner posts are formed of straight plastic tubes.

4. The container of claim 3 wherein the corner posts are connected to the upper side rails and bottom side rails by means of tubular T connectors.

5. The container of claim 4 wherein the cross rails are connected to the bottom side rails by means of tubular T connectors.

6. The container of claim 1, and further comprising a flexible flap hingedly connected to an upper side rail of the frame structure for extension across the space between the two side rails, to thereby close the container top opening.

7. The container of claim 6, and further comprising an elongated tubular weight secured to a free side edge of the flexible flap for suspension along an outer side surface of the fabric cover to maintain the flap in position over the container top opening.

8. A collapsible toy container comprising: a three dimensional rectangular frame structure that includes two parallel upright side frames;

each side frame comprising an upper tubular side rail, a bottom tubular side rail, and two upright tubular corner posts extending therebetween;

two parallel tubular cross rails (60, 62) extending between the bottom side rails on the respective side frames; said cross rails being located inwardly from the ends of the respective bottom rails;

a flexible fabric cover having a hollow bag-like configuration; said fabric cover comprising a bottom fabric panel having a rectangular configuration matching the plan dimensions of the space circumscribed by the corner posts, two fabric flat side panels extending right angularly from side edges of the bottom panel, and two fabric flat end panels extending right angularly from end edges of the bottom panel; the upstanding side edges of the end panels being joined to the adjacent side edges of the side panels, whereby the panels form a hollow flexible bag structure;

openings in the end panels at the four corner areas where the end panels meet the bottom panels and side panels;

bottom corner connectors extending from the ends of the bottom side rails for extension through the openings in the fabric end panels when the three dimensional frame structure is positioned on the bottom panel of the bag structure;

bottom end rails releasably connected to adjacent ones of the corner connectors;

and upper end rails releasably connected to upper ends of adjacent ones of the corner posts;

said bag structure having internal dimensions mated to the external dimensions of the rectangular frame structure, whereby the bag structure end panels and side panels can be pulled upwardly to grip outer surface areas of the corner posts.

9. The container of claim 8 wherein the upper edges of the fabric end panels are spaced below the upper edges of the fabric side panels whereby clearance spaces are formed above the upper edges of the side panels;

said upper end rails being located outside the fabric covver in horizontal alignment with the adjacent clearance spaces, whereby said upper end rails can be used as handles to move the container.

10. The container of claim 9 and further comprising upper corner connectors extending from the ends of the upper side rails for extension through said clearance spaces; said upper end rails being attached to said upper corner connectors.

* * * * *